US005662414A

United States Patent [19]

Jennings et al.

[11] Patent Number: 5,662,414

[45] Date of Patent: Sep. 2, 1997

[54] THERMOPLASTIC PAN ASSEMBLY FOR MOUNTING RECESSED LIGHTING FIXTURES IN CEILINGS AND THE LIKE

[75] Inventors: Mark E. Jennings, Crawfordsville, Ind.; James P. Yates, Charleston; Greg D. Yates, Casey, both of Ill.

[73] Assignee: NSI Enterprises, Inc., Atlanta, Ga.

[21] Appl. No.: 642,313

[22] Filed: May 3, 1996

[51] Int. Cl.[6] ..... F21S 1/06

[52] U.S. Cl. ..... 362/366; 362/365; 362/404

[58] Field of Search ..... 362/365, 366, 362/147, 148, 404, 430

[56] References Cited

U.S. PATENT DOCUMENTS 4,803,603 2/1989 Carson ..... 362/404

5,057,979 10/1991 Carson et al. ..... 362/147

*Primary Examiner*—Carroll B. Dority

*Attorney, Agent, or Firm*—Kenneth E. Darnell

[57] ABSTRACT

A recessed downlighting fixture mountable in a ceiling between spaced joists or carried by T-bars and the like to direct light downwardly into an environmental space. The invention particularly takes the form of a pan assembly preferably formed of a thermoplastic material of a rigidity sufficient to support standard cans or reflector housings and associated lamping, electrical wiring inter alia. A junction box preferably formed of the same thermoplastic material is mounted to the pan assembly, access being gained to the interior of the box at opposite sides the box through positive latching doors which remain open to facilitate wiring operations within the box. The thermoplastic pan mounts adjustable bar hangers for rough-in of the downlighting assembly.

23 Claims, 4 Drawing Sheets

THERMOPLASTIC PAN ASSEMBLY FOR MOUNTING RECESSED LIGHTING FIXTURES IN CEILINGS AND THE LIKE

DESCRIPTION OF THE PRIOR ART

1. Field of the Invention

The invention relates generally to mounting structure for a downlight assembly recessed in a ceiling or the like and particularly to low-cost, compact pan assemblies formed of thermoplastic material.

2. Background of the Invention

The term "downlighting" refers generally to a type of lighting enjoying substantial popularity due in part to the ability of lighting fixtures providing such lighting to be recessed into the ceiling of an environmental space in both new construction and in retrofit situations. In "downlighting" situations, lighting fixture assemblies pen se are located above the ceiling or sub-ceiling of a room with major portions of the fixtures being covered by the ceiling, the fixtures themselves thus being unobtrusive while providing efficient illumination within the environmental space directly below an aperture in the ceiling through which light is directed from lamping carried by the fixtures. A downlight or recessed lighting fixture thus can be utilized with virtually any decoration scheme to accomplish varied lighting tasks such as highlighting of particular decorative or functional elements within the environmental space or in combination with other downlights and/or other lighting to provide general lighting within the space. In new construction, recessed lighting fixtures or downlights are intended for mounting to a ceiling support structure such as between joists or by mounting to a gridwork supporting a suspended ceiling installation as another example. In a conventional mounting of a downlight fixture, a mounting frame is provided which is structurally secured to joists or to a gridwork above a ceiling or sub-ceiling, a junction box being carried by the mounting frame and being connected to a source of electrical power through conduit extending from the junction box to a connection with a lamp housing typically referred to as a "can". Conventional structure of this general description may incorporate a reflector assembly within the can or may utilize a reflector assembly as the lamp housing or can. In a typical recessed lighting situation, the recessed lighting fixtures are installed either between joists of a ceiling or mounted to a gridwork supporting a ceiling, a ceiling then being formed through use of conventional materials to hide the recessed lighting fixture with the exception of an opening in the ceiling which allows light from the fixture to be directed substantially downwardly into the environmental space which is to be lit. Those conventional structural elements comprising the recessed lighting fixture, that is, the housing or can, the junction box and bar hangers, among other elements, are carried by a frame member generally referred to as a "pan". Pans conventional in the art are typically formed of heavy-gauge painted steel platforms which are typically rectangular or square and which mount bar hanger structures along oppositely spaced edges of these conventional pans. Mounting pans of the prior art are used with recessed lighting fixtures capable of operating with incandescent lamps in most commercial and residential situations. However, it is common in certain situations to utilize fluorescent and metal halide lighting inter alia with conventional mounting pans forming a portion of a recessed light fixture. When utilizing fluorescent lighting, the pan must usually be capable of mounting a ballast element for operation of the fluorescent light source.

Even in light of the substantial weight of conventional metal pans, it is still common in the art to utilize heavy steel pan structures as the supporting platforms in downlighting fixture assemblies. Due to the size and weight of prior pan frame structures including those portions of a recessed lighting fixture mounted to such structures, the cost of shipping "downlighting" fixtures is substantial due not only to the volume required for containment of a single fixture within a shipping box or the like but also due to the weight of the total assembly wherein a major portion of the weight is due to the weight of the metal pan. A need thus exists in the art for a replacement for the stamped sheet metal pan commonly employed as the primary mounting platform of a recessed lighting fixture such as a conventional downlight. A need further exists in the art for a less expensive downlight assembly such as could be provided from a discontinuation of the use of stamped sheet metal pans. Since the total expense of a downlighting assembly delivered to a job site for installation also includes shipping costs, a more compact downlighting assembly such as could occur through the use of a volumetrically efficient mounting pan for reduction of shipping costs would certainly constitute an improvement in the art.

A number of patents previously issued relate to "pan" structures capable of mounting a standard can or reflector housing as well as junction boxes and the like. As an example, U.S. Pat. No. 4,471,416 to Druffel describes a conventional metal mounting pan having bar hanger assemblies on each side of the pan formed of hanger elements slidably connected to each other so that the overall length created by the bar hangers may be adjusted to accommodate a particular spacing between supporting members such as the joists of a typical rough ceiling. The flat sheet metal pan of Druffel is provided with an aperture cut from the pan, a standard can being mounted above the aperture so that light from a lamp carried within the can is directed through the aperture and into an environmental space which is to be lit. Capostagno et al, in U.S. Pat. No. 4,313,154, provides a similar sheet metal pan which is stamped along opposite edges to bend opposite edge portions of the pan into a track through which a hanger bar is inserted. The hanger bars are formed of a pair of elements which may be adjusted relative to each other to accommodate a particular spacing between supporting members such as the joists in a roughed-in ceiling. The ends of the hanger bars are provided with barbed nailers which allow ready nailing to the joists or the like to connect the fixture assembly in place between joists or other support structure. As such, Capostagno et al is exemplary of the great majority of pan structures which must be stamped to form holder elements for bar hangers. The resulting structure is expensive due to the need to form bar hanger mounting channels through stamping techniques with additional cost and complexity being brought about by the need to then mount the relatively slidable hanger elements together for relative sliding within the stamped channel so formed. The prior art has experienced a long felt need for an improved mounting of bar hangers to recessed lighting fixtures which are to be mounted in a ceiling or the like with a primary intent being the ability to maintain the bar hangers in place on the lighting fixture assembly once assembled in a factory situation. By maintaining bar hangers in place on the fixture itself including the mounting pan, the hanger structure does not become separated from the remaining portions of the fixture assembly during shipping or during subsequent handling at a job site.

Carson et al, in U.S. Pat. No. 5,057,979, describes a recessed lighting fixture which is formed in certain embodiments of plastic to include a frame for holding a lamp housing as well as a junction box. The Carson et al frame is configured to be nailed to a vertical planar face of a joist or the like.

The present invention is directed to those needs referred to above which are long felt in the art and which have called for improvement even in the face of the general suitability of prior art metal stamped mounting pans and those recessed lighting fixture assemblies mounted thereby. In particular, the present invention improves recessed lighting fixture assemblies by providing a mounting pan formed substantially of thermoplastic material and mounting a junction box also preferably formed of the same material. The mounting pan so formed is of low-cost and is extremely light in weight, thereby providing substantial advantages in the art relative not only to the manufacture and use of the present mounting pan assemblies but also in the shipping of such pan assemblies which further allow for reduction in delivered cost. The present pan assemblies also provide integral rail holding slots whereby bar hanger assemblies are mounted for sliding movement at two locations of the lighting fixture assembly, a first location being slots integrally formed in juxtaposition to the junction box with the second location being on the pan itself. The present invention thus provides substantial improvement over pan assemblies of the prior art by providing inexpensive, compact and volumetrically efficient pan structures which are light in weight relative to prior art pan assemblies and which are capable of mounting the substantial weights of recessed lighting fixtures in suspended arrangements between joists or other supporting framework without warping or deflection of the pan structure when assembled in place.

SUMMARY OF THE INVENTION

An improved recessed lighting fixture assembly is provided by the present invention wherein the primary improvement relates to a pan structure and the formation of that structure from a thermoplastic material, the structure being moldable of the thermoplastic material by means of injection molding or the like to integrally include bar hanger mounting structure and which is readily and rapidly formable. The thermoplastic pan of the invention can be inexpensively and compactly configured yet will exhibit extraordinary resistance to warping and deformation under loading even when mounted in a use environment involving the support of substantial weight such as the weight of a standard can or reflector housing, lamping held within the housing to direct light through an opening, the necessary electrics for operation of the lamping and bar hangers necessary for mounting of the fixture assembly to joists or other supporting structure. The pan assembly of the invention is preferably molded of a polymeric material, preferably a thermoplastic material, in a single piece which includes a pan body having an opening formed therein of a size to allow a housing can to be carried by the pan assembly, the pan assembly further comprising a junction box fixedly mountable therewith. Molding of the pan assembly through use of a polymeric material facilitates the integral formation of hanger bar mounting structure with the pan assembly as well as a thermoplastic junction box permanently mountable to the pan assembly, the junction box being dimensioned to receive electrical cable of a wide range of sizes. Knock-outs are also provided in the junction box and are integrally formed therewith during the plastic molding process used to form the junction box. While it is preferred to form the present pan assembly from a thermoplastic polymeric material, it is to be understood that the pan assembly could be cast of a metal, and particularly of a light weight metal such as zinc, without departing from the scope of the invention. Knock-outs formed of cast metal would generally take a form different from the form of plastic knock-outs although a wide variety of knock-out structures could be employed for either type of embodiment. The preferred embodiments of the invention utilize substantially circular knock-outs and are capable of receiving non-metallic sheathed cable as well as cable which is sheathed with metal. As will be seen hereinafter, metal sheathed cable is preferred.

While the pan assembly and junction box of the invention are preferably molded of thermoset or thermoplastic material, it is to be understood that the pan assembly can be molded from polymeric material of different type but having suitable and flame resistant properties. The several structures could be formed of different materials such as by formation of the pan assembly from thermoplastic material with the junction box being formed of metal and then mounted to the pan assembly. Regardless of the materials chosen for formation of the pan assembly and for formation of the junction box and other structure to be mounted by the pan assembly of the present invention, the pan assembly of the invention must be capable of supporting a housing can, a junction box, bar hanger assemblies, etc., and must retain rigidity to hold the fixture in place. The pan assembly, in order to function in a remodeling application, must also be flexible while retaining the ability to support the weight of lamping, electrical conductor-bearing conduit for supplying power to the lamping and bar hangers inter alia without diminution of function when compared to more expensive platform-like pans such as are common in the art. The compact nature of the present pan structure allows conservation of shelf space in storage due to the volumetric efficiency of the pan assembly and which further allows reduced shipping costs due not only to lower assembly weight but also to a reduction in space occasioned by the structure of the pan itself. The pan assembly is preferably formed of a flame retardant mix of polymeric materials which can include ABS and polyvinyl chloride such as is common in the polymer arts.

The thermoplastic pan of the invention is preferably molded integrally with a dual-access junction box formed of the same polymeric material as is the main body of the pan assembly, the pan assembly being provided with a base portion to which the junction box is mounted. The junction box can be provided with hinged covers, snap-on covers or covers having living hinges provided by a flexible flap of plastic material which can be integrally formed as is desired. The junction box is located on the present pan assembly at one end thereof and surmounts a pair of spaced slots which receive in aligned relationship a hanger bar assembly which can be lengthwise adjusted to fit the dimensions of a particular mounting situation. On that end of the pan assembly opposite the location of the junction box and spaced essentially diametrically across the opening in the pan assembly above which a housing can is mounted, a second hanger bar assembly is carried by structure capable of mounting the hanger bar assembly. The structure intended to mount the hanger bar assemblies on opposite sides of the central opening of the pan assembly are integrally formed in the molding process which produces the thermoplastic pan assembly, thereby simplifying the recessed lighting fixture for which the present thermoplastic pan provides the primary mounting platform. The bar hanger assemblies are each comprised of two extendible portions capable of sliding movement relative to each other, each of the bar hanger assemblies being supported by the pan assembly such that the bar hanger assemblies may be each extended to a desired length for mounting between joists or the like at an appropriate spacing as is occasioned by a particular mounting situation.

The thermoplastic pan assembly of the invention acts as a basic mounting platform for remaining elements of a recessed lighting fixture or the like in addition to the bar hanger assemblies and can housing referred to hereinabove. The inventive pan assembly further mounts electrical structure including metal sheathed cable or the like extending from electrical connections interiorly of the junction box to lamping structure housed within the can mounted in surmounting relation to the opening formed in the pan assembly. As aforesaid, bar hanger assemblies are also mounted by the thermoplastic pan to allow mounting between joists or to a gridwork of a suspended ceiling or the like. As is conventional in the art, a pair of bar hanger elements comprising a bar hanger assembly have distal ends formed as barbed nailer plates which are integral with the bar hanger elements, the nailing plates allowing convenient and rapid mounting to joists as necessary in a given mounting situation. The recessed downlighting fixture having the present thermoplastic pan as the mounting platform acts as a rough-in above a ceiling, the ceiling hiding the fixture except for the provision of the opening in the pan assembly which allows light from lamping housed in the can to illuminate an environmental space below the ceiling. The recessed lighting fixtures of the invention are readily installed in new construction and may also be installed in remodeling situations from a location beneath the ceiling. The cans mounting appropriate incandescent or other lamping are typically formed of metal including steel, aluminum or the like which are carried by the pan assembly of the invention.

Accordingly, it is a primary object of the invention to provide an inexpensive and lightweight mounting pan for carrying a standard can or reflector housing of a recessed downlighting fixture as well as a junction box structure, bar hanger assembly or assemblies and the like for mounting above a ceiling such as between joists or to gridwork suspending a ceiling, the pan assembly of the invention preferably formed of a thermoplastic material causing the invention to be capable of improved function such as resistance to warping and deformation in use even though formed of less material than prior pan assemblies.

It is another object of the invention to provide a recessed lighting fixture improved by a pan assembly formed of a thermoplastic material and further having a junction box integrally formed therewith as well as integrally formed bar hanger assembly mounting structure such that the thermoplastic pan of the invention is capable of mounting of a standard can or reflector housing as well as bar hanger assemblies necessary for mounting of the recessed lighting fixture above a ceiling of an environmental space which is to be lit.

It is yet another object of the invention to provide an inexpensive and lightweight pan assembly formed of a thermoplastic material and preferably formed integrally with a junction box inter alia for assembly in a factory situation with standard cans or reflector housings, bar hanger assemblies and the like and which exhibits a reduced volume relative to prior art recessed fixture assemblies, thereby allowing a reduction in shipping costs and improved utilization of shelf space due to the volumetric efficiency of the recessed lighting fixture brought about by incorporation into the fixture of the thermoplastic pan of the invention.

Further objects and advantages of the invention will become more readily apparent in light of the following detailed description of the preferred embodiments.

DESCRIPTION OF THE PREFERRED EMBODIMENTS

Figures 1, 3:
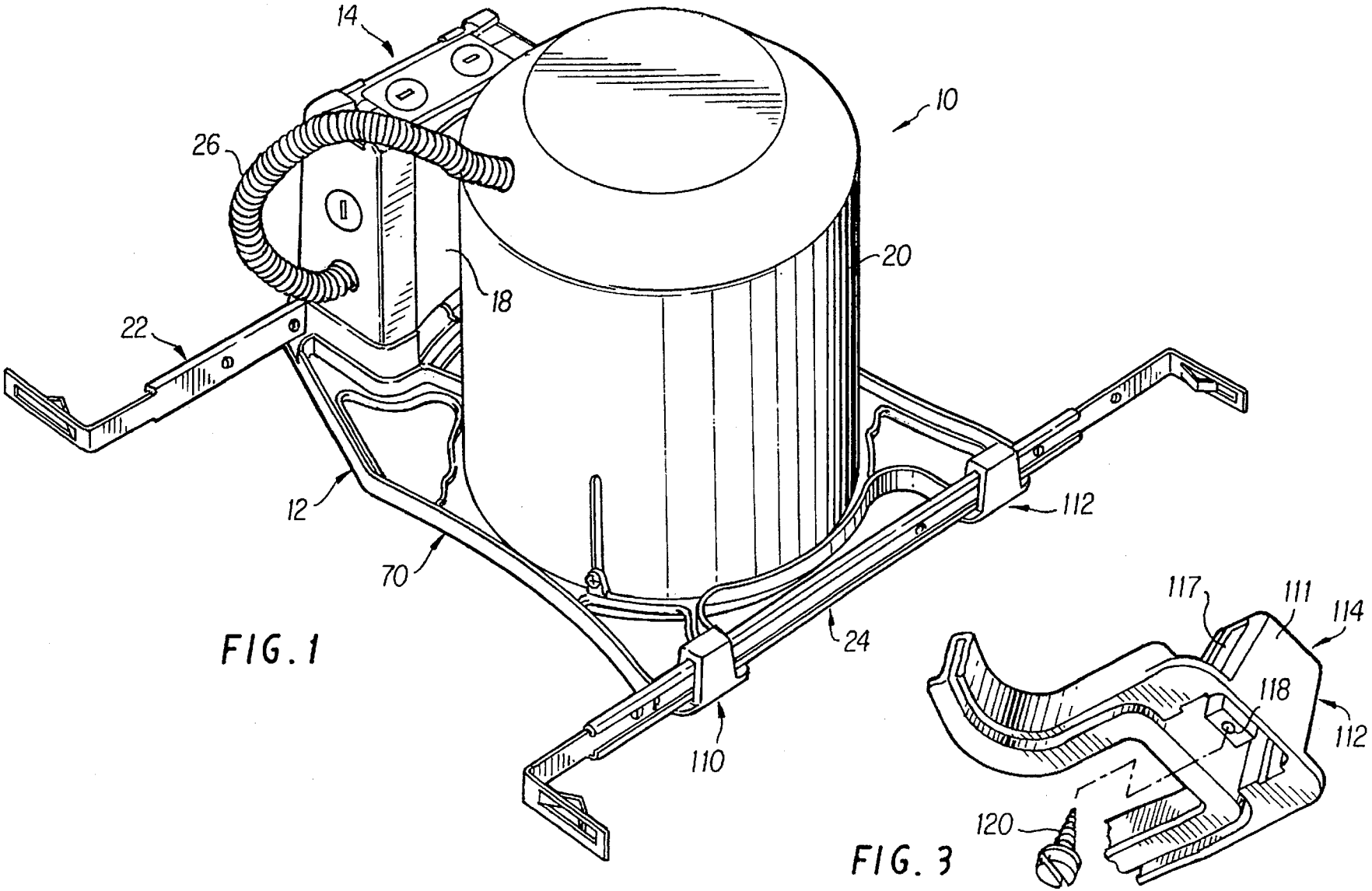
FIG. 1 is a perspective view of the present recessed downlighting fixture improved by the provision of the present thermoplastic assembly.
FIG. 3 is a detailed perspective view of a portion of the pan assembly which mounts a bar hanger assembly.
Figure 5:
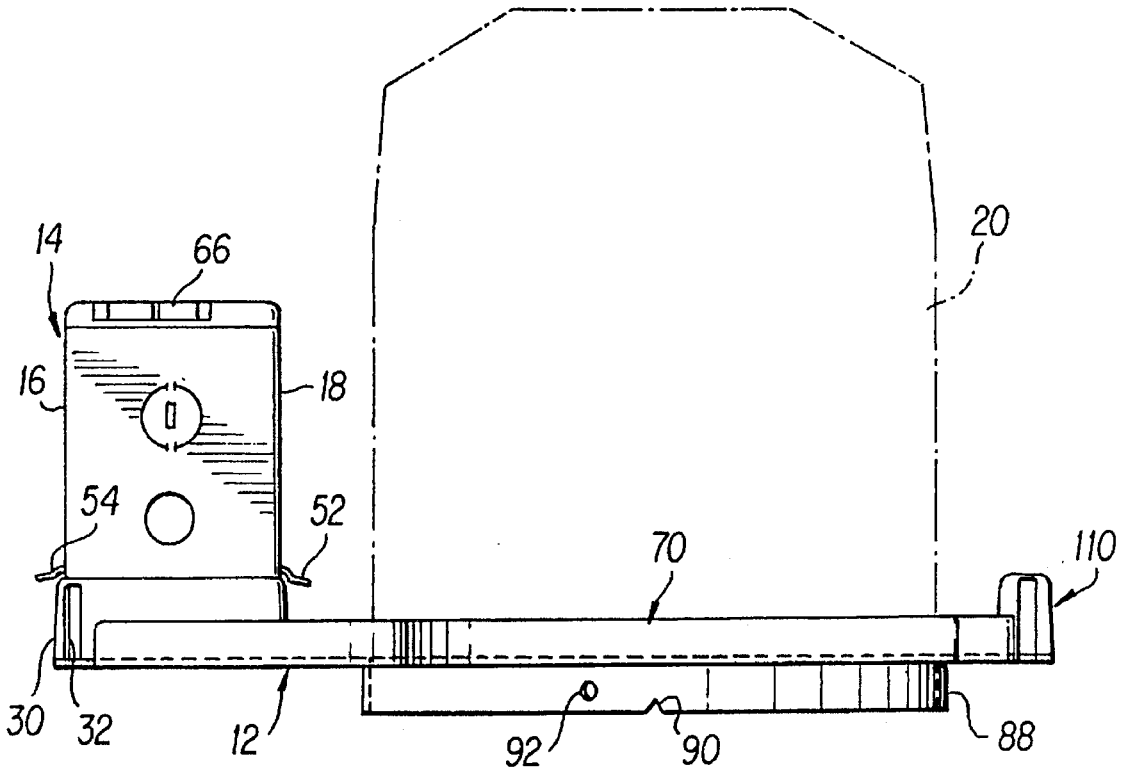
FIG. 5 is a side elevational view of the pan assembly of FIG. 4.

Referring now to the drawings and particularly to FIGS. 1 and 5, a recessed downlighting fixture is generally seen at 10 to comprise a pan 12 configured according to the invention. The pan 12 is formed of a thermoplastic material such as by injection molding and mounts a junction box 14 having hinged covers 16 and 18 which allow access to the interior of the junction box 14. The pan 12 functions in a manner similar to any of a variety of prior art pan structures to mount the junction box 14, the pan 12 also mounting a can 20 within a central circular opening 86 formed in the pan. Bar hangers 22 and 24 as well as other structure to be described hereinafter are also mounted by the pan. The recessed fixture 10 is mounted above a ceiling to produce a downlighting affect in the environmental space below the ceiling. An armoured conduit 26 or insulated cable containing insulated electrical wiring extends from the junction box 14 to the can 20 to allow the insulated wiring entry into the interior of the can 20 to provide power to a lamp (not shown) mounted within the interior of the can 20. The connection of electrical power to lamping within the can 20 through the junction box 14 is conventional and need not be described in detail herein.

Figure 2:
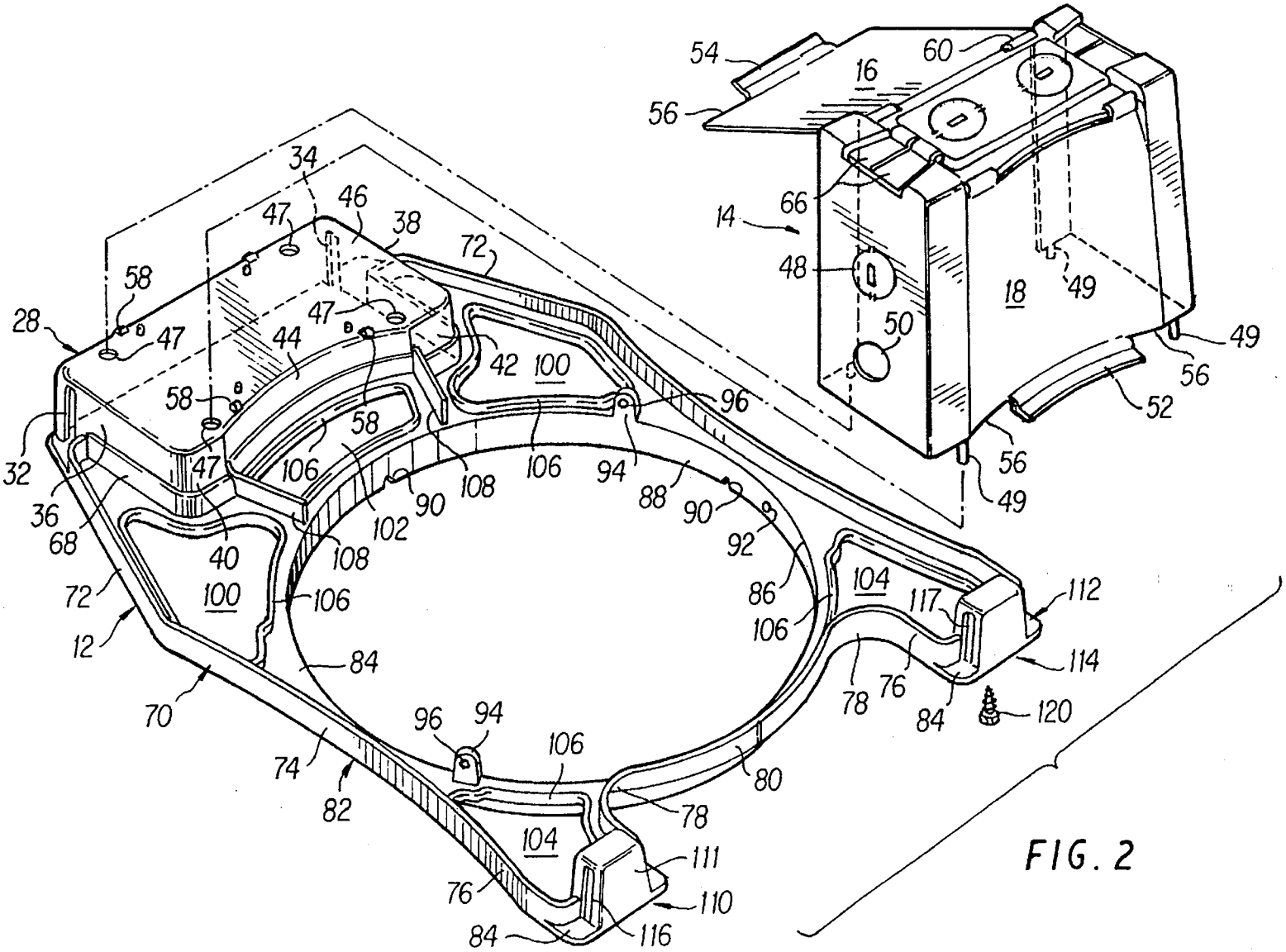
FIG. 2 is a perspective view of a pan assembly including a junction box which is separately formed from a primary frame structure of the pan assembly, the junction box being shown in an "exploded" arrangement.
Figure 4:
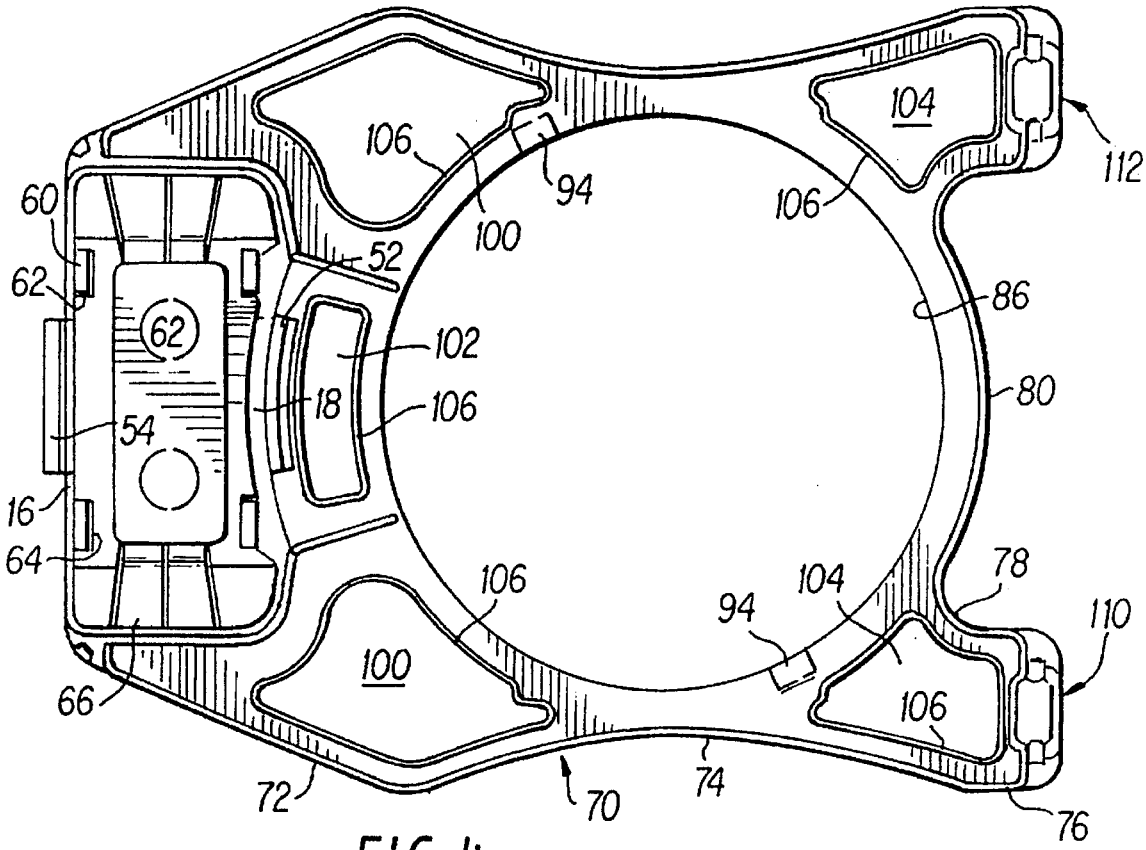
FIG. 4 is a plan view of the assembled pan assembly.

As can be seen in FIGS. 2 and 4, the junction box 14 is preferably molded of the same thermoplastic material selected for formation of the pan 12. As noted above, the junction box 14 could be formed of metal or other material in a conventional manner and then connected to the pan 12. Whether or not formed of the same thermoplastic material, the junction box 14 preferably attaches to the pan 12 in a fixed assembly relation which secures the box 14 to the pan 12 in a manner Which effectively causes the box 14 and the pan 12 to be virtually integral in structure. Formation of the pan 12 and the junction box 14 from the same thermoplastic material particularly facilitates this securement of the box 14 to the pan 12 to provide this essentially integral combination of the box 14 with the pan 12. The junction box 14 mounts to a base 28 integrally molded as part of the pan 12. The base 28 includes a substantially planar rear wall 30 which subtends at either end thereof a slot 32 and a slot 34, the slots 32 and 34 comprising structure capable of holding bar hanger 22 to the pan 12 on insertion of said bar hanger 22 through the slots 32, 34 (see also FIG. 1). The slots 32, 34 are further subtended by respective side walls 36 and 38 which comprise portions of the base 28. The base 28 further includes end walls 40 and 42 which round respectively from the side walls 36, 38 and then connect to each other by means of an arcuate front wall 44. The walls 36, 38, 40, 42 and 44 are surmounted at their upper edges by means of a base platform 46 to which the junction box 14 is suitably mounted by means of pegs 49 formed integrally with the junction box 14 substantially at lowermost corners thereof, the pegs 49 being received in apertures 47 formed in the base platform 46. The pattern of the apertures 47 is identical to the pattern of the pegs 49 to allow the pegs to be readily received into the apertures 47, lowermost perimetric edges of the junction box 14 thus coming into contact with perimetric portions of the base platform. The junction box 14 thus seats on the base platform 46 and is fixedly held thereto in a virtually integral manner by capping of the pegs 49 such as by heating to soften at least upper portions of the pegs followed by the exertion of pressure on the tops of the pegs downwardly, thereby to hold the junction box 14 to the base 28. The base platform 46 is then disposed interiorly of the junction box 14 to form the floor thereof.

The junction box 14 is provided with a number of pryouts 48, also sometimes referred to as knock-outs, which can be readily removed from the junction box to allow use of electrical nonmetal tubing (ENT) or armoured (or metal) cable (EMT) which is to be inserted into the interior of said junction box 14. The conduit 26 essentially comprises EMT while the ENT is not shown. An opening 50 formed in a side wall of the junction box 14 is sized to receive a Romex clamp (not shown) in order to provide for an additional means for electrically connecting the junction box 14 to lamping within the can 20. Romex essentially comprises non-metallic sheathed cable and its use first requires breaking of a tab on the Romex clamp (not shown), pre-stripped cable (not shown) being then brought into the junction box 14 through molded-in clamps 66. Supply leads (not shown) are then connected using integral push-in wire connectors (not shown). The junction box 14 can therefore be rapidly wired using varied wiring systems. The covers 16 and 18 of the junction box 14 are respectively hinged above front and rear openings formed in the junction box and can be readily swung open to allow access to the interior of the junction box 14. Once opened, the covers 16 and 18 remain open to allow ready access to the interior of the junction box 14 when swung upwardly above the openings. On completion of wiring within the junction box 14, the cover or covers are closed. Finger pulls 52 and 54 respectively formed on the covers 16 and 18 allow easy opening of said covers, edge portions 56 on either side of each of the pulls 52 and 54 on each cover 16, 18 cooperate with snap elements 58 formed on the base platform 46 just inside of the openings which are closed by the covers 16, 18 to allow snap-latching of said covers in place. The snap elements 58 are formed in the base platform 46 during molding. A stop 59 disposed immediately behind and to the side of each of the snap elements 58 prevent inward displacement of the covers 16, 18. The covers 16, 18 are each provided with integral C-shaped snap hinge portions 60 formed on upper edges thereof, the hinge portions 60 being disposed near the upper corners of the covers 16 and 18. The C-shaped portions 60 snap onto bar elements 62 formed two each on each side of the junction box 14 immediately above the openings normally covered by the covers 16, 18 and at the upper corners of the openings. Each of the bar elements 62 are located in a spaced relation to a slot 64 formed immediately behind each of said bar elements 62. The C-shaped portions snap-fit over the respective bar elements 62 to provide a hinge. It is to be understood that the covers 16 and 18 could be integrally formed with the junction box 14 such as by formation of a "living" hinge. Still further, other hinge structures could be employed to movably mount the covers 16 and 18 to the junction box 14 for covering the front and rear openings into the interior of the junction box 14. However, the covers 16 and 18 utilizing the hinge arrangements thus described can be "flipped" upwardly to positions whereby the covers remain open to allow "user friendly" access to the interior of the junction box 14 until it is desired to close the box. The molded-in clamp 66 formed in the junction box 14 at oppositely disposed ends thereof as referred to above act to hold a non-metallic sheathed cable (Romex) or the like to the junction box 14 on insertion thereof through one of the clamps 66.

The base 28 of the pan 12 is reinforced by means of a reinforcing rib 68 which is integrally formed to the side walls 36, 38 as well as the end walls 40, 42 and the arcuate front wall 44 of the base 28. The rib 68 connects to and is integrally formed with pan exterior wall 70 which extends essentially about the full periphery of the pan 12 and comprises a major structural portion thereof. The pan wall 70 rounds from connection with the rib 68 to straight portions 72 on each side of said pan 12, the straight portions 72 angling from the junction box 14 and curving inwardly at locations forwardly of the junction box 14 to form major arcuate wall portions 74. The wall 70 then recurves laterally at the forward end of the pan 12 to form essentially U-shaped portions76 which then recurve rearwardly to arcuate portions 78. The arcuate portions 78 then join through an outwardly directed arcuate portion 80, the structure described thus forming the pan exterior wall 70 which essentially defines the pan 12 and lends substantial structural strength to the pan 12.

The pan exterior wall 70 forms major portions of a frame 82 of the pan 12, the frame 82 having essentially planar portions which lie in a plane essentially perpendicular to the exterior wall 70. These planar portions are best referred to as the planar floor 84 of the frame 82, the floor having the central circular opening 86 formed therein as aforesaid. The can 20 is disposed in surmounting relation to the opening 86 to direct lighting through said opening 86 and then through an opening in a ceiling (not shown) which is surmounted by the opening 86 of the pan 12. A circular plaster flange 88 extends perpendicularly from the floor 84 downwardly below the frame 82 about the opening 86. The plaster flange 88 is provided with regularly spaced triangular indents 90 and four regularly spaced holes 92 to facilitate mounting functions. Mounts 94 having apertures 96 formed therein receive screws 98 (seen in FIG. 1) for direct connection to slots 91 formed in opposite side walls of the can 20. The slots 91 are elongated vertically and allow vertical adjustment of the can within the opening 86.

The floor 84 of the pan 12 is provided with cutouts 100 spaced forwardly and to the sides of the junction box 14, the cutouts 100 being irregularly shaped in a manner corresponding to the shape of the frame 82 so that sufficient material is present about the periphery of each of the cutouts 100 to form a stable pan 12 but which allows removal of material to allow the pan 12 to be as light in weight as possible and to use a minimum of material in formation of the pan 12. Immediately forwardly of the junction box 14, an arcuate cutout 102 is formed in the floor 84. Further, irregularly shaped cutouts 104 are formed in the floor 84 immediately inwardly of the wall portion 76 on either side of the pan 12, the cutouts 102 and 104 having a function which is identical to that of the cutouts 100 as aforesaid. Each of the cutouts 100, 102 and 104 are provided with a bead-like strengthening rib 106 which follows the full periphery of said cutouts and provides strength. Further strength is provided to the pan 12 by means of diagonally directed ribs 108 which extend from the base 28 toward the opening 86, the ribs 108 terminating at the opening 86 and joining at inner ends thereof to the reinforcing ribs 68 described previously.

At the ends of the pan 12 opposite the location of the junction box 14, the floor 84 extends beyond the exterior wall 70 and mounts rail holders 110 and 112. As can also be seen in FIG. 3, the rail holders 110 and 112 each comprise hollow body members 114 wherein an inner wall of each of the members 114 is formed substantially integrally with the respective arcuate portions 78 of the exterior wall 70. An outward wall 111 of each of the members 114 terminates at the portion of the floor 84 which extends exteriorly of the wall 70. Slots 117 are formed in each side portion of each of the rail holders 110 and 112, the slot 117 being dimensioned to allow the bar hanger 24 to be received therethrough, the bar hanger 24 thus being carried by each of the rail holders 110 and 112. The rail holder 112 is further provided with a threaded aperture 118 disposed internally of the rail holder 112 and formed in a boss integrally formed with the member 114 to receive a screw 120 which allows locking of the bar hanger 24 in place on the pan 12.

The structure and function of the bar hangers 22 and 24 are essentially identical. While various bar hanger structures can be utilized with the present pan 12, those structures described in copending U.S. patent application Ser. No. 08/610,431, filed Mar. 4 , 1996, entitled Wire Frame Pan Assembly for Mounting Recessed Lighting in Ceilings and the like, and assigned to the present assignee are preferred. Reference is hereby made to the copending patent application and the disclosure of said copending patent application is incorporated hereinto by reference.

Figure 6:
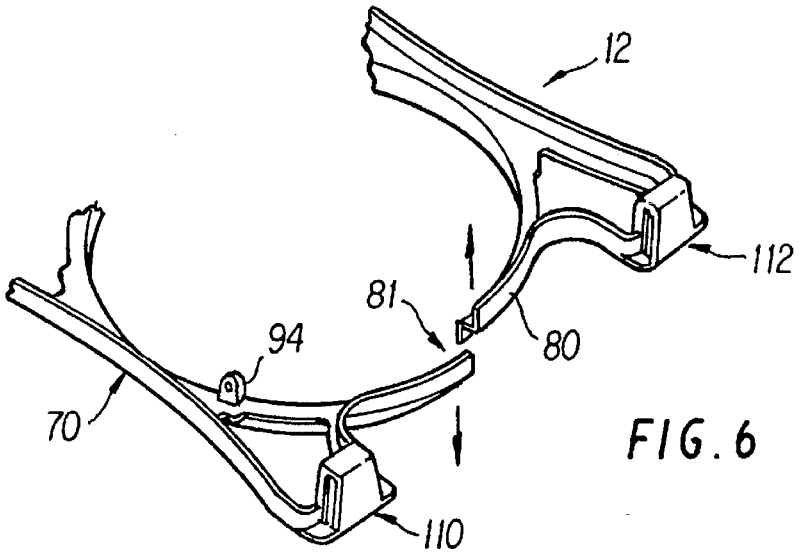
FIG. 6 is a detailed perspective view of a portion of the pan assembly illustrating preparation of the pan assembly for insertion into a ceiling hole in a remodeling application.
Figure 7:
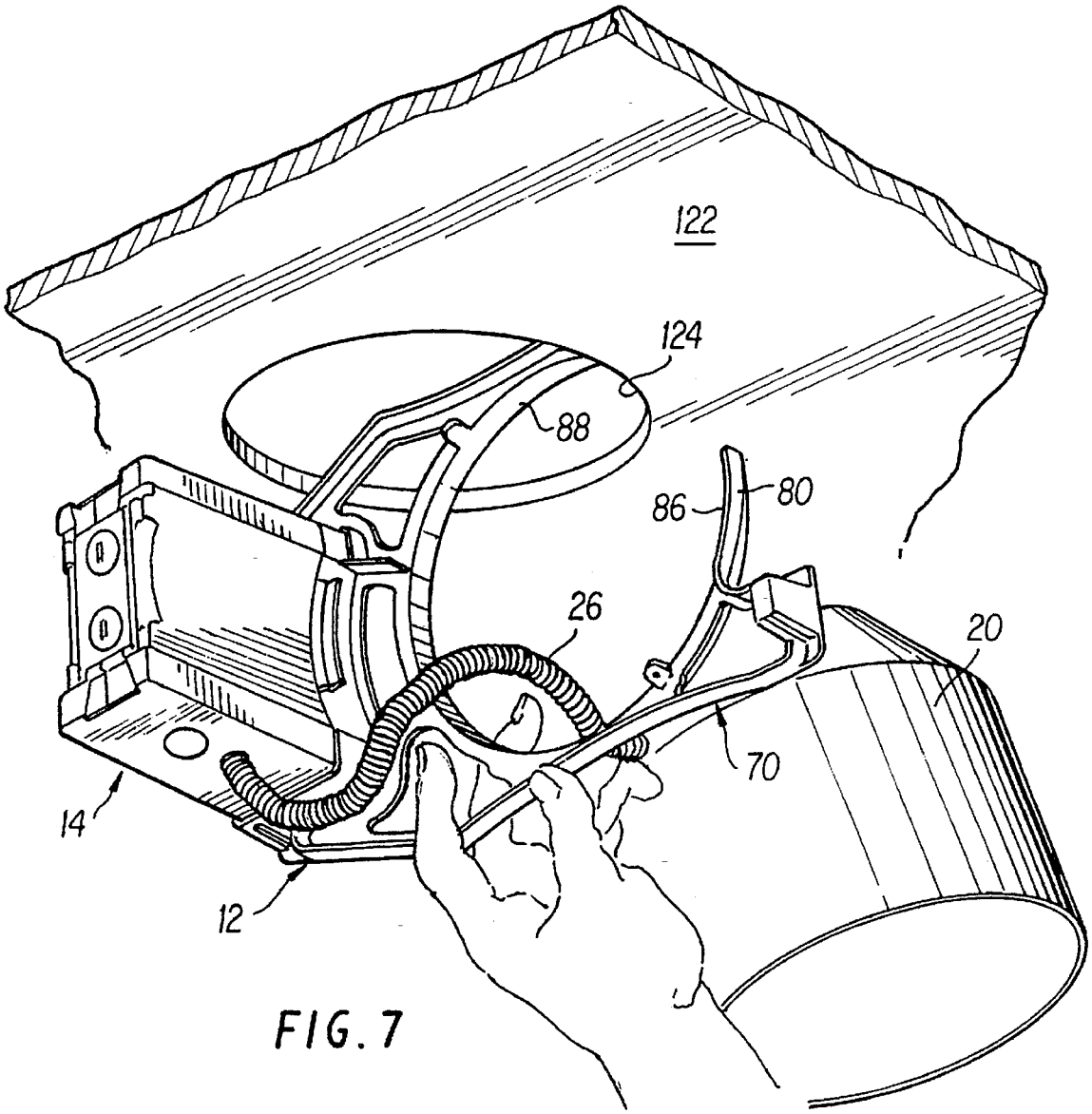
FIG. 7 is a perspective view of the step of inserting the pan assembly as prepared according to FIG. 6 into the ceiling hole for installation of the pan assembly in a remodeling application.

FIGS. 6 and 7 illustrate installation of the pan 12 into a hole 124 formed in ceiling 122 in a remodeling application. Since the pan 12 is of dimensions too great to allow insertion of the pan 12 directly into the hole 124, the pan 12 is cut at 81 to impart a certain flexibility to the pan 12. With the can 20 removed from the opening 86 but attached to the junction box 14 by means of conduit 26 as shown in FIG. 7, an end of the pan 12 created by the cut at 81 is first inserted into the hole 124 and the pan 12 is twisted into and through the hole 124. Finishing nails (not shown) are then used to nail the pan 12 into place in surmounting relation to the hole 124, the nails being inserted through the holes 92 located in the plaster flange 88. The plaster flange 88 essentially fits within the hole 124 since the hole 124 has been cut to the same dimension as that of the plaster flange 88. The holes 92 are thus directly proximus to walls of the hole 124 and thus receive the finishing nails which are hammered through the holes 92 into said walls of the hole 124. The can 20 is then inserted through the opening 86 in the pan 12 and attached using the screws 98 inserted through the slots 91 to be received in the apertures 96 formed in the mounts 94, the screws 98 being inserted first through the slots 91 from within the interior of the can 20 as also occurs in a new construction "rough-in".

As can be readily understood in view of the particular embodiments of the invention which are expressly described hereinabove, the invention can be embodied other than as expressly described herein without departing from the intended scope of the invention, the scope of the invention being defined by the recitations of the appended claims.

What is claimed is:

1. A pan for mounting a lamp housing, a junction box, electrical connections between the junction box and the housing and bar hanger assemblies for mounting the resulting assembly to portions of a building structure, comprising:

a pan body having a floor defining a periphery of the pan body, the floor having an opening formed therein for receiving at least portions of the lamp housing;

means carried by the pan body for holding the housing to the pan body;

a base formed integrally with the pan body at a first end thereof and extending above the floor, the base having perimetric walls extending from the floor, which walls join to and are integrally formed with the floor, the base having aligned slots formed in oppositely disposed perimetric walls near outermost portions thereof, the slots receiving at least portions of one of the bar hanger assemblies for support of the pan at said first end of the pan body on mounting to portions of a building structure, the base mounting the junction box with the junction box being located within the periphery of the pan body defined by the floor;

support means formed integrally on leg-like portions of the floor at a second end of the pan body for mounting one of the bar hanger assemblies, each support means comprising a body member having aligned slots formed in opposing wall portions thereof for receiving at least portions of the bar hanger assembly therethrough; and, a structural wall extending from and above the floor and formed integrally with the pan body and extending about the periphery of the pan body from either side of the base and joined to the oppositely disposed perimetric walls of the base having the slots formed therein and inwardly of the slots and further joining to an outermost wall portion 6f each body member of the support means inwardly of the slots formed therein, the structural wall imparting strength and rigidity to the pan to facilitate support by the pan of structure carried by said pan.

2. The pan of claim 1 wherein the pan is integrally formed of a thermoplastic material.

3. The pan of claim 1 wherein the housing has vertical slots formed in spaced walls thereof and the means for holding the housing to the pan body comprise raised tab-like mounts formed in spaced relation about the periphery of the opening and extending from the floor, the mounts each having an aperture formed therein, the mounts further aligning one each with one each of the slots formed in the housing, the holding means further comprising at least one fastening element which is received through one of the slots in the housing and the aperture in one of the mounts, thereby to hold the housing within the opening in the pan body, the fastening element being slidable within the slot in the housing and relative to the housing to adjust the position of the housing within the opening.

4. The pan of claim 1 wherein the holding means comprise means for vertically adjusting the position of the housing within the opening.

5. The pan of claim 1 wherein portions of the floor interiorly of the structural wall are cut-away to reduce pan weight.

6. The pan of claim 5 wherein the periphery of the cut-away portions of the floor have an integral peripheral bead formed thereabout.

7. The pan of claim 1 and further comprising strengthening ribs formed integrally with and disposed about those portions of the perimetric walls of the base adjacent to the floor between the locations at which the structural wall joins to the base and within the periphery defined by the structural wall, the ribs being integral with the floor and joining integrally to the structural wall at the location at which the structural wall joins to the base.

8. The pan of claim 7 and further comprising diagonal ribs joined integrally to at least a portion of the strengthening ribs and to the floor and extending from the base from an innermost wall of the perimetric walls and toward the opening in the floor, thereby further strengthening the pan.

9. The pan of claim 8 wherein that portion of the innermost wall disposed between the juncture thereof with the diagonal ribs is arcuate in contour and opposes an arcuate perimetric portion of the opening in the floor, an arcuate cut-out being disposed in the floor between the arcuate portion of the innermost wall and the opening and between the diagonal ribs, the cut-out so formed reducing the weight of the pan without reduction of the strength and rigidity of the pan.

10. The pan of claim 9 wherein a cut-out is disposed in the floor between opposing portions of the base, the structural wall, the opening in the floor and each one of the diagonal ribs, the cut-outs so formed reducing the weight of the pan without reduction of the strength and rigidity of the pan.

11. The pan of claim 1 and further comprising a flange extending about the periphery of the opening in the floor, the flange having openings formed therein to receive fastening elements therethrough for attaching the flange and thus the pan to portions of a building structure.

12. The pan of claim 1 wherein the body member of each of the support means is hollow and open at the bottom thereof, the support means further comprising means carried within each of the body members for locking said one of the bar hanger assemblies to the pan, the locking means being accessible from underneath of the pan to allow locking of said bar hanger assembly once the bar hanger assembly is affixed to portions of a building Structure at a desired location thereof.

13. The pan of claim 12 wherein the locking means comprise an inner wall portion of the hollow body member having a threaded aperture formed therein for receiving a screw therewithin to connect to and lock the bar hanger assembly to the pan.

14. The pan of claim 1 wherein portions of the floor within the periphery defined by the structural wall are discontinuous to reduce the weight of the pan.

15. The pan of claim 1 wherein a central portion of the structural wall located between the leg-like portions of the floor at the second end of the pan body is arcuate in contour.

16. The pan of claim 15 wherein ends of the central portion of the structural wall recurve respectively outwardly to join one each to the body member of each support means at an inner side wall thereof, a cut-out being disposed in each leg-like portion of the floor between opposing portions of lateral portions of the structural wall, portions of the floor adjacent the opening, recurved portions of the structural wall inwardly of each body member and inwardly disposed exterior walls of each body member, the cut-outs so formed reducing the weight of the pan without reduction of the strength and rigidity of the pan.

17. The pan of claim 15 wherein a cut line is disposed centrally of the central arcuate portion of the structural wall, severing of the structural wall and a portion of the floor adjacent thereto allowing the pan to be bent to be received into an opening in a ceiling or the like above which the pan is to be disposed for mounting to portions of a building structure.

18. The pan of claim 1 wherein the junction box is formed with a door on each major face thereof to allow access into the junction box from either major face thereof, and further comprising means for maintaining the doors in an open position to facilitate access into the interior of the junction box.

19. The pan of claim 18 wherein the junction box is formed of a thermoplastic material.

20. In a recessed lighting fixture assembly having a pan supporting a lamp housing, a junction box, electrical connections between the junction box and the housing and bar hanger assemblies for mounting of the fixture assembly to portions of a building structure, the improvement comprising:

a pan frame formed of a pan body having a floor defining a periphery of the pan body, the floor having an opening formed therein for receiving at least portions of the lamp housing;

a base formed integrally with the pan body at a first end thereof and extending above the floor, the base having perimetric walls extending from the floor, which walls join to and are integrally formed with the floor, the base having aligned slots formed in oppositely disposed perimetric walls near outermost portions thereof, the slots receiving at least portions of one of the bar hanger assemblies for support of the pan at said first end of the pan body on mounting to portions of a building structure, the base mounting the junction box and supporting said junction within the periphery of the pan body to provide effective support of said junction box;

support means formed at a second end of the pan body for mounting one of the bar hanger assemblies, the support means having aligned slots formed therein for receiving at least portions of the bar hanger assembly therethrough; and, a structural wall extending from and above the floor and about major perimetric portions of the floor, the pan frame being integrally formed of a plastic material.

21. In the improvement of claim 20 and further comprising strengthening ribs formed integrally with and disposed about those portions of the perimetric walls of the base adjacent to the floor between locations at which the structural wall join to the base and within the periphery defined by the structural wall, the ribs being integral with the floor and joining integrally to the structural wall at the locations at which the structural wall joins to the base.

22. In the improvement of claim 21 and further comprising diagonal ribs joined integrally to at least a portion of the strengthening ribs and to the floor and extending from the base from an innermost wall of the perimetric walls and toward the opening in the floor, thereby further strengthening the pan.

23. In the improvement of claim 20 wherein the junction box is formed of a plastic material.

* * * * *

UNITED STATES PATENT AND TRADEMARK OFFICE

CERTIFICATE OF CORRECTION

PATENT NO. : 5,662,414

DATED : September 2, 1997

INVENTOR(S) : Mark E. Jennings; James P. Yates; Greg D. Yates

It is certified that error appears in the above-identified patent and that said Letters Patent is hereby corrected as shown below:

Column 10, line 36, change "6f" to -- of --.

Signed and Sealed this

Fourth Day of November, 1997

Bruce Lehman

*Attest:*

BRUCE LEHMAN

*Attesting Officer*

*Commissioner of Patents and Trademarks*